US005369723A

United States Patent [19]

Counts et al.

[11] Patent Number: 5,369,723

[45] Date of Patent: Nov. 29, 1994

[54] TOBACCO FLAVOR UNIT FOR ELECTRICAL SMOKING ARTICLE COMPRISING FIBROUS MAT

[75] Inventors: Mary E. Counts, Richmond; Susan E. Wrenn, Chesterfield, both of Va.

[73] Assignee: Philip Morris Incorporated, New York, N.Y.

[21] Appl. No.: 943,747

[22] Filed: Sep. 11, 1992

[51] Int. Cl.[5] ..... A24F 1/00; H05B 3/00

[52] U.S. Cl. ..... 392/386; 131/194; 128/202.21

[58] Field of Search ..... 392/386, 390, 395, 403, 392/404; 131/194, 335; 261/94–107; 239/34–60; 422/305–306; 128/202.21

[56] References Cited

U.S. PATENT DOCUMENTS

| | | | |
|---|---|---|---|
| 3,255,760 | 6/1966 | Selke . | |
| 3,608,560 | 9/1971 | Briskin et al. . | |
| 3,738,374 | 6/1973 | Bennett . | |
| 3,744,496 | 7/1973 | McCarty et al. . | |
| 4,319,591 | 3/1982 | Keith et al. . | |
| 4,505,282 | 3/1985 | Cogbill et al. . | |
| 4,793,365 | 12/1988 | Seasabaugh, Jr. et al. | 131/194 |
| 4,802,574 | 2/1989 | Akiba | 206/204 |
| 4,893,639 | 1/1990 | White | 131/369 |
| 4,947,875 | 8/1990 | Brooks et al. | 131/330 |
| 4,991,596 | 2/1991 | Lawrence et al. | 131/194 |
| 5,060,671 | 10/1991 | Counts et al. | 131/329 |
| 5,093,894 | 3/1992 | Deevi et al. . | |
| 5,119,834 | 6/1992 | Shannon et al. | 131/194 |
| 5,144,962 | 9/1992 | Counts et al. | 131/194 |
| 5,146,934 | 9/1992 | Deevi et al. | 131/359 |
| 5,249,586 | 10/1993 | Morgan et al. | 131/194 |

*Primary Examiner*—Bruce A. Reynolds
*Assistant Examiner*—John A. Jeffery
*Attorney, Agent, or Firm*—Charles E. B. Glenn; James E. Schardt; Kevin B. Osborne

[57] ABSTRACT

A tobacco flavor unit is provided for use in a smoking article for delivering to a smoker a tobacco flavor substance, the smoking article having electrical heating means disposed in a cavity. The tobacco flavor unit includes a carbon fibrous mat and tobacco flavor medium disposed on the mat for providing for the efficient generation of tobacco flavor substance. The carbon mat includes carbon fibers that are made from a precursor selected from the group consisting of rayon, pitch and polyacrylonitrile. A smoking article incorporating the tobacco flavor unit is also provided.

75 Claims, 9 Drawing Sheets

TOBACCO FLAVOR UNIT FOR ELECTRICAL SMOKING ARTICLE COMPRISING FIBROUS MAT

BACKGROUND OF THE INVENTION

This invention relates to smoking articles in which tobacco flavor media are heated to release tobacco flavors. More particularly, this invention relates to electrically heated smoking articles.

An electrically heated smoking article is described in commonly-assigned U.S. Pat. No. 5,060,671, which is hereby incorporated by reference in its entirety. That patent describes an electrically heated smoking article which is provided with a disposable set of electrical heating elements on each of which is deposited an individual charge of tobacco flavor medium containing, for example, tobacco or tobacco-derived material. The disposable heater/flavor unit is mated to a more or less permanent unit containing a source of electrical energy such as a battery or capacitor, as well as control circuitry to actuate the heating elements in response to a puff by a smoker on the article or the depression of a manual switch. The circuitry is designed so that at least one but less than all of the heating elements are actuated for any one puff, so that a predetermined number of puffs, each containing a pre-measured amount of tobacco flavor substance, is delivered to the smoker. The circuitry also preferably prevents the actuation of any particular heater more than once, to prevent overheating of the tobacco flavor medium thereon and consequent production of undesired compounds yielding off tastes.

In such a smoking article, the heating elements are disposed of along with the spent tobacco flavor medium. This results in increased costs to the smoker, who must buy new heating elements with each refill of tobacco flavor medium. The volume of material disposed of is also greater when the heating elements must be disposed of.

In addition, when the heating elements are disposable, they must by their nature be removable. As a result, there is sometimes excessive contact resistance at the connection where the removable heaters are electrically connected to the source of electrical energy, resulting in increased power consumption. Furthermore, that connection must be designed to withstand repeated insertion of new heating elements after each use.

Also, when the heating elements are disposable, the heater electrical resistance may vary from heater to heater, resulting in variations in power consumption which, in turn, can lead to variations in temperature. As it is the temperature to which the tobacco flavor medium is heated that determines the characteristics of the tobacco flavor substance, those characteristics will also vary.

The above-discussed disadvantages associated with U.S. Pat. No. 5,060,671 are addressed by copending, commonly-assigned U.S. patent application Ser. No. 07/666,926, filed Mar. 11, 1991, now abandoned in favor of filewrapper continuation application Ser. No. 08/012,799 filed Feb. 2, 1993, which is hereby incorporated by reference in its entirety. That application describes an electrically heated smoking article that has reusable heating elements and a disposable portion for tobacco flavor generation. The disposable portion preferably includes a flavor segment and a filter segment, attached by a plug wrap or other fastening means.

A disadvantage of reusable heating elements is that residual aerosol can settle and condense on the heating elements and other permanent structural components of the smoking article, resulting in the generation of undesirable aerosol components if the residual aerosol is reheated after new disposable tobacco flavor medium is inserted into the article. Such residue is referred to as "fixture contamination."

The disadvantages associated with condensed residual aerosol are addressed by copending, commonly-assigned U.S. patent application Ser. No. 07/943,504 (PM-1550), filed concurrently herewith, which is hereby incorporated by reference in its entirety. That application describes an electrical smoking article having a permanent heater fixture and a removable tobacco flavor unit for delivering to a consumer a tobacco flavor substance. The heater fixture and tobacco flavor unit are designed and arranged to prevent condensation of aerosol on certain components, so that the generation of undesirable aerosol components is minimized.

Whether a smoking article employs disposable or permanent electrical heaters, it is desirable that the heaters are able to reach an operating temperature of between about 200° C. and about 700° C. when in thermal contact with tobacco flavor medium with minimum electrical energy input. Such operating temperatures are effective in efficiently generating tobacco flavor substances.

It is also desirable that the smoking article minimize the generation of undesirable flavors and the heating of non-tobacco flavor material.

It is further desirable that the tobacco flavor material of the smoking article generates large quantities of aerosol and flavorants with minimum electrical energy input.

SUMMARY OF THE INVENTION

It is an object of this invention to provide a smoking article that employs disposable or permanent electrical heaters, in which the heaters are able to reach an operating temperature of between about 200° C. and about 700° C. when in thermal contact with tobacco flavor medium with minimum electrical energy input. Such operating temperatures are effective in efficiently generating tobacco flavor substances.

It is also an object of this invention to provide a smoking article which minimizes the generation of undesirable flavors and the heating of non-tobacco flavor materials.

It is a further object of this invention that the tobacco flavor material of the smoking article generates large quantities of aerosol and flavorants with minimum electrical energy input.

In accordance with this invention, there is provided a tobacco flavor unit for use in a smoking article for delivering to a smoker a tobacco flavor substance, the article having electrical heating means disposed in a cavity. The tobacco flavor unit includes a carbon fibrous mat having a first surface and a second surface, and the mat is adapted to be disposed adjacent the electrical heating means. Tobacco flavor medium is disposed on the first surface of the mat. When the electrical heating means is activated, a respective fraction of the tobacco flavor medium in thermal transfer relationship with the heating means is heated, generating a predetermined quantity of tobacco flavor substance for delivery to the smoker. The carbon mat includes carbon fibers that are made from a precursor selected from the group consisting of rayon, pitch and polyacrylonitrile.

In accordance with the present invention there is also provided a smoking article that incorporates the tobacco flavor unit of the present invention. In the smoking article, aerosol generation can be selectively controlled by controlling the application of the tobacco flavor material to the fibrous carbon mat. The smoking article efficiently produces aerosol with minimum waste of energy.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE INVENTION

Figure 1:
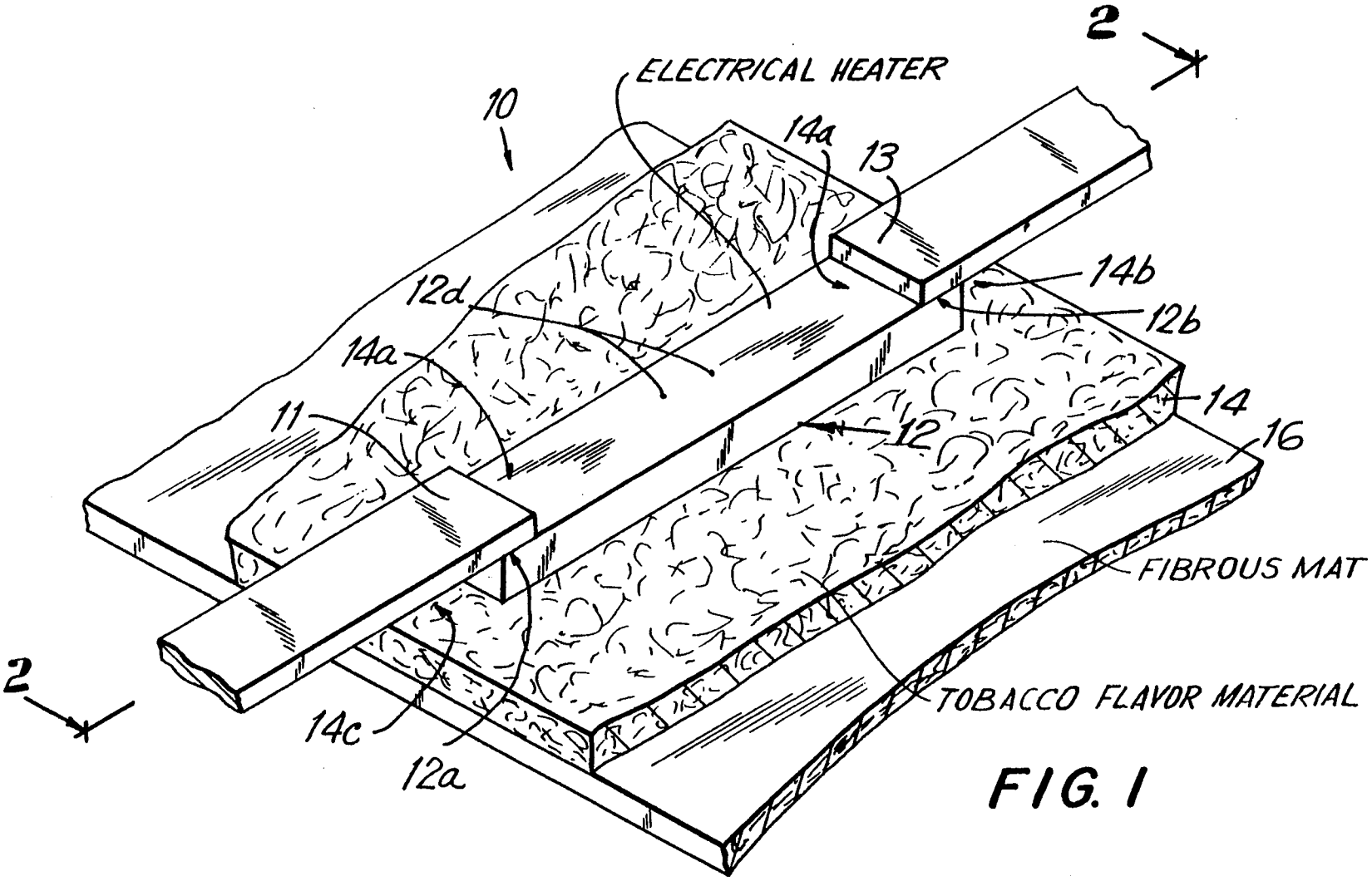
FIG. 1 is a partially fragmentary perspective view of a first embodiment of a tobacco flavor unit according to this invention.

The basic tobacco flavor unit of the present invention includes tobacco flavor material disposed on the surface of a fibrous mat that provides for the efficient generation of tobacco flavor substance. A smoking article incorporating the tobacco flavor unit of the present invention can be used, for example, as a cigarette. In such a case, the tobacco flavor material would be a material containing tobacco or tobacco derivatives.

In accordance with the invention, a smoking article preferably includes one or more electrical heaters, one or more tobacco flavor units of the present invention, one or more filters, a source of electrical energy, and control circuitry for energizing the heaters of the article in an appropriate sequence in response to manual actuation or puff-induced actuation. Articles in which the tobacco flavor unit of the present invention can be incorporated are described in the above-incorporated commonly-assigned U.S. Pat. No. 5,060,671, U.S. patent application Ser. No. 07/666,926, a U.S. patent application Ser. No. 08/012,799 and U.S. patent application Ser. No. 07/943,504 (PM-1550).

In accordance with the present invention, the heaters for use with the tobacco flavor unit may be disposable or permanent. Whether the heaters are permanent or disposable, the tobacco flavor material can be any material that liberates flavors when heated. Such materials include continuous sheets, foams, gels, or cast slurries (including spray-deposited slurries), which may or may not contain tobacco or tobacco-derived materials.

The tobacco flavor material may include various amounts and combinations of tobacco blends, humectants, flavorants, gum additives or other binders. It is desirable that the tobacco flavor material contain an aerosol precursor to deliver the tobacco flavor substance as an aerosol, so that when the smoker exhales the tobacco flavor substance, the visible condensed aerosol may mimic the appearance of cigarette smoke.

In addition to the tobacco flavor material, the tobacco flavor units of the present invention include a carbon fibrous mat that provides for the efficient generation of tobacco flavor substance. As will be discussed in more detail below, the carbon fibrous mat is used as either a carrier to structurally support the tobacco flavor material, or as a barrier to minimize undesirable flavor generation, or both.

Whether the carbon fibrous mat is used as carrier or barrier, it is made from a plurality of carbon fibers which are bound together to form a mat. The carbon fibrous mat of the present invention has the properties of structural integrity and thermal stability at high temperatures, and low basis weight. These features of the present invention are attributed to the carbon fibers of which the mat is composed.

The carbon fibrous mat of the present invention can be made by a variety of methods. For example, the carbon fibers could be woven together to form a mat composed substantially of a matrix of the fibers. More preferably, however, the carbon fibers used in the present invention are bonded together using a binder so as to form a non-woven mat composed substantially of a matrix of the fibers. Additionally, the carbon fibers could be incorporated into other host matrices so that the fibers modify the properties of the host matrix. In the latter embodiment, the carbon fibers are used to impart thermal stability and structural integrity at high temperatures to the host matrix in which the carbon fibers are incorporated.

In accordance with the present invention, the carbon fibers are composed substantially of carbon. Such fibers are made by carbonizing a carbon fiber precursor material selected from the group consisting of rayon, pitch and, more preferably, polyacrylonitrile (PAN). The carbonization of such precursors results in a carbon fiber that is either rayon-based, pitch-based, or polyacrylonitrile-based, depending upon the precursor material used to produce the fiber. Although to some extent the characteristics of the particular type of carbon fiber depends upon the precursor material and process used to produce it, carbon fibers are generally characterized by high carbon content (usually exceeding about 90%), moderate flexibility, thermal—and to a large extent chemical—inertness, and good thermal and electrical conductivities.

Whether the carbon fibers are rayon-, pitch- or polyacrylonitrile-based, the binder used to form a mat composed substantially of a matrix of the fibers, can be any type of binder which allows a mat to be formed and which is suitable for use in smoking articles (i.e., having acceptable subjective properties). Some binders having these preferred characteristics include polyvinyl alcohol (PVA), sugars, starches or modified starches, alginates, cellulose-based adhesives, and artificial or natural gums such as konjac flour, pectin and guar gum. It will be apparent that other binders could also be used. For example, highly fibrillated pulp fibers, where bonding is generally mechanical, or tobacco slurry-based binders could be used. Preferably, the binder comprises from about 3% to 6% of the overall basis weight of the mat, although percentages above or below this range may also be used.

If the fibers of the present invention are incorporated into another host matrix so as to modify the properties of the host, the matrix should allow formation of a mat which is suitable for use in smoking articles (i.e., having acceptable subjective properties). Some host matrices having these preferred characteristics include cellulose-based matrices such as paper, or paper-like matrices such as textile fabric gauzes. Additionally, tobacco-based matrices could also be used. It will be apparent that other host matrices could also be used (e.g., relatively moisture and heat resistive gels or binder films such as calcium treated alginates).

Whatever type of host matrix is used, fibers according to the present invention can be incorporated therein at weight percentages of up to about 100%. If necessary at higher weight percentages, binders similar to those discussed above could be incorporated into the mat in order to facilitate fiber bonding.

Whether the fibers are used to form their own mat or incorporated into another host matrix, preferably the fibers have a diameter in the range from about 7 μm to about 30 μm. Preferably, the fibers have a length that allows the fibrous mat to withstand the processing required in order to incorporate the mat into a smoking article. Thus, whether the fibers are used to form their own mat or whether they are incorporated into a host matrix, the resulting fibrous mat should preferably be able to withstand typical processing tensile loads of up to about 35 to 40 N/m (as determined by tensile stress tests with mats 2.5 cm wide by 15 cm long in the direction of the stress, at a ramp rate of about 2.54 cm/min).

If the fibers are incorporated into a host matrix, it will be apparent to those skilled in the art that the preferred fiber length may depend upon the type of host matrix into which the fiber is incorporated and the weight percent of the added fibers. If the fibers are bonded together to form their own fibrous mat for use in a smoking article as shown in the above-incorporated U.S. patent application Ser. No. 07/943,504 (PM-1550), then whatever the length of the fibers, the resulting mat should preferably have a thickness in the range from about 0.05 mm to about 0.11 mm and have a carbon fiber component basis weight in the range of from about 6 $g/m^2$ to about 12 $g/m^2$. Such thicknesses and masses allow for the efficient generation of tobacco flavor substance with minimum electrical power consumption because of the reduction in heat loss to non-tobacco flavor materials. A mat having the specified thickness and carbon fiber basis weight is strong enough to support the tobacco flavor material, yet thin and light enough so as not to be a significant heat sink. It will be apparent to those of skill in the art that thicknesses and basis weights outside the preferred ranges may also be used.

Figure 2:
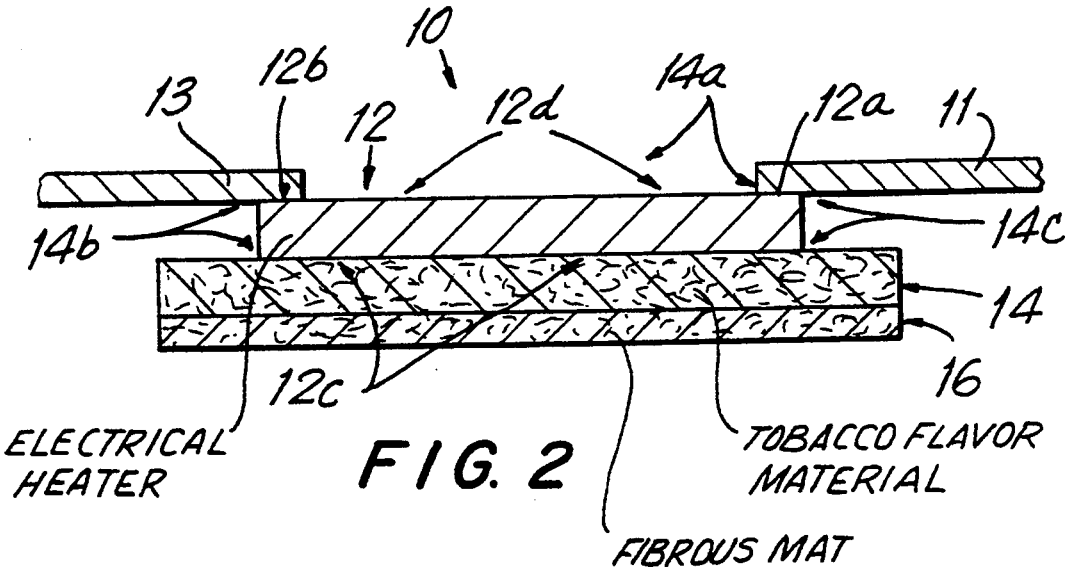
FIG. 2 is cross-sectional view of the tobacco flavor unit of FIG. 1, taken from line 2—2 of FIG. 1.

A schematic view of a first preferred embodiment of a tobacco flavor unit 10 according to the present invention is shown in FIGS. 1 and 2. Unit 10 includes electrical heater 12, tobacco flavor material 14 and fibrous mat 16 which is used as a carrier for tobacco flavor material 14. Electrical connections to ends 12*a*, 12*b* of heater 12 are provided through contacts 11, 13, respectively.

In accordance with the present invention, fibrous mat 16 is used to structurally support tobacco flavor material 14. Advantageously, fibrous mat 16 has low basis weight that does not present a large thermal load to electrical heater 12. Consequently, tobacco flavor material 14 can be heated to a given predetermined temperature by heater 12 with less electrical power consumption than at higher basis weights.

Additionally, as discussed above, fibrous mat 16 has structural integrity and is thermally stable at high temperatures. Thus, even though tobacco material 14 and fibrous mat 16 may be exposed to temperatures between about 200° C. and about 700° C., fibrous mat 16 will substantially retain its structural integrity, and therefore will not fall apart, and will furthermore not contribute substantially to undesirable flavor generation during operation of heater 12. These features of the present invention, and particularly the structural integrity of fibrous mat 16, are especially important if heater 12 is a permanent heater while tobacco flavor material 14 and fibrous mat 16 are disposable. Under these conditions, structural integrity is important in order to allow the tobacco flavor material to be removed from the heater region without leaving behind waste.

An additional feature of the present invention shown in FIGS. 1 and 2 is that heater 12 is not exposed to large heat sinks, thus allowing efficient generation of tobacco flavor substance without wasting a lot of electrical power to achieve a predetermined heater temperature. In accordance with the present invention, air is used to thermally insulate heater 12 from other parts of tobacco flavor unit 10 and other parts of the smoking article (not shown) into which unit 10 is incorporated.

For example, heater 12 in the present embodiment is substantially flat with two surfaces 12*c* and 12*d*. Surface 12*c* is in intimate thermal transfer relationship with tobacco flavor material 14. In accordance with the present invention, heater 12 is surrounded by air gaps 14*a*, 14*b* and 14*c*. These air gaps are defined by the geometrical arrangement of heater 12 within tobacco flavor unit 10.

In particular, air gap 14*a* is defined by heater surface 12*d* and electrical contacts 11 and 13. Because of the presence of air gap 14*a*, which provides good thermal isolation, heat which is generated by heater 12 is not able to directly propagate in a direction away from tobacco flavor material 14 towards air gap 14*a*. Thus, because of the insulating nature of air gap 14*a*, less electrical power is needed to achieve a predetermined heater temperature than would otherwise be required if heater surface 12*d* were in direct contact with a supporting material.

Additionally, air gaps 14*b* and 14*c* are defined by heater 12, tobacco flavor material 14 and electrical contacts 13, 11, respectively. Because of the insulating nature of these air gaps, lateral propagation of heat away from the region of tobacco flavor material 14 in direct physical contact with heater 12 is minimized. Thus, if air gaps 14*b* and 14*c* where replaced with other material in direct physical contact with heater 12 or tobacco flavor material 12, larger electrical power consumption would be required to heat heater 12 to a predetermined temperature.

The influence of air gaps, such as air gaps 14*b*, 14*c*, in effecting heater efficiency is discussed in more detail in Example I below.

Although contacts 11, 13 as shown in FIGS. 1 and 2 have been identified as "electrical contacts," it is to be understood that contacts 11, 13 could also represent heater supports which are used to structurally support heater 12. In such a case, electrical contacts could be made to heater ends 12*a*, 12*b* through some other means not shown in FIGS. 1 and 2, if the heater supports are not able to also serve as electrical contacts. Additionally, if only one structural support is needed to support heater 12, one of contacts 11, 13 shown in FIGS. 1 and 2 could represent that structural support, whereas the second one of contacts 11, 13 could represent an electrical contact.

FIGS. 1 and 2 show a tobacco flavor unit wherein the fibrous mat 16 is employed as a "carrier" to structurally support the tobacco flavor material. A disadvantage of this particular embodiment when heater 12 is a permanent heater is that the heater is directly exposed and in physical contact with the tobacco flavor material. For permanent heater designs, this direct exposure may result in undesirable flavor generation because of condensation of tobacco flavor substance onto the permanent heaters, which upon subsequent reheating may generate undesirable flavors. Furthermore, some particular tobacco flavor materials may have a tendency to adhere to heater 12 after it is heated. Such adhesion may make it difficult to remove the disposable tobacco flavor material from the heater region after heater activation, if the heaters are a permanent part of the smoking article. Any residues not fully removed would get reheated along with the new supply of tobacco flavor material, which again may contribute to undesirable flavor generation.

Figure 4:
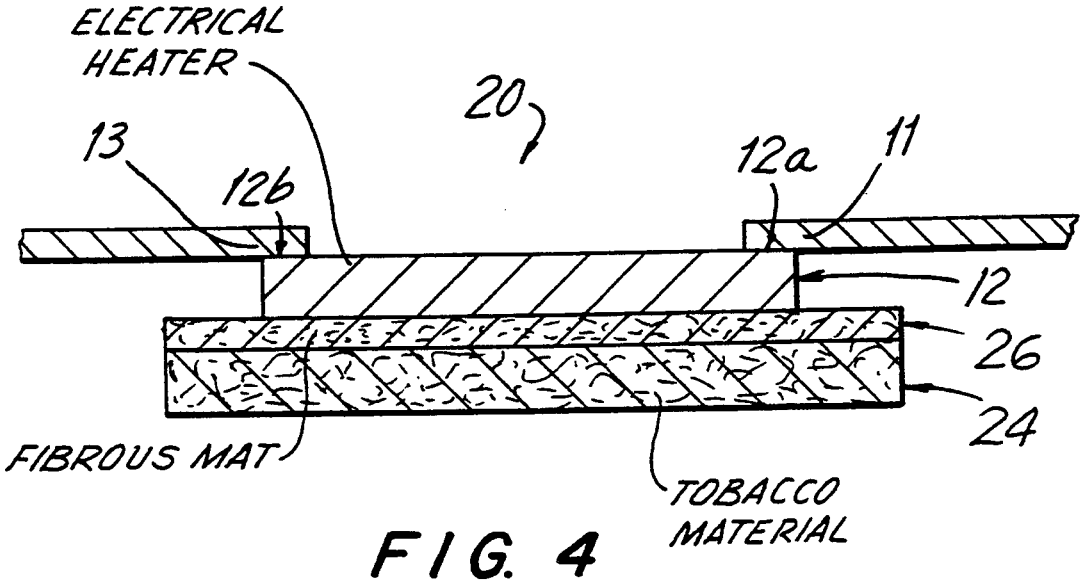
FIG. 4 is cross-sectional view of the tobacco flavor unit of FIG. 3, taken from line 4—4 of FIG. 3.
Figure 3:
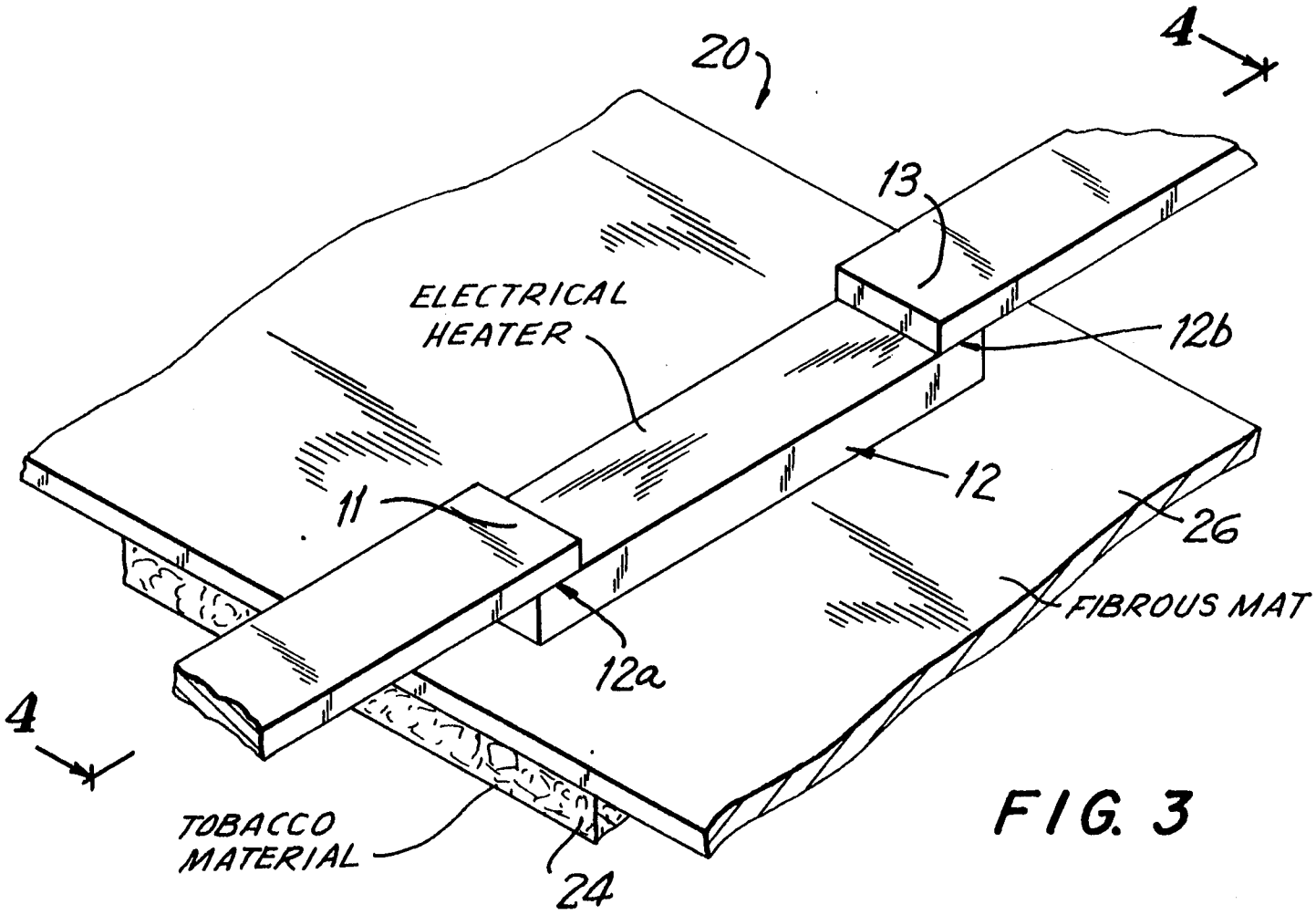
FIG. 3 is a partially fragmentary perspective view of a second embodiment of a tobacco flavor unit according to this invention.

A second more preferred embodiment of a tobacco flavor unit 20 according to the present invention is shown in FIGS. 3 and 4. Unit 20 includes electrical heater 12, tobacco flavor material 24 and fibrous mat 26, which again is used a carrier for tobacco flavor material 24. However, in contrast to unit 10 shown in FIGS. 1 and 2, unit 20 also employs fibrous mat 26 as a "barrier" to isolate heater 12 from direct exposure to tobacco flavor material 24. Otherwise, tobacco flavor unit 20 is similar to tobacco flavor unit 10.

Because fibrous mat 26 separates heater 12 from tobacco flavor material 24, adhesion of material 24 to heater 12 is minimized. Furthermore, tobacco flavor substance and aerosol that is generated by tobacco flavor material 24 is less likely to deposit on heater 12, and therefore generate undesirable flavors, than would otherwise be the case if heater 12 were directly exposed to tobacco flavor material 24. The permeability of aerosol and other flavorants through fibrous mat 26 is one factor which will determine the amount of deposition and of the generation of such undesirable flavors.

Unit 20 is especially useful in a permanent heater-type smoking article wherein the tobacco flavor material insert is removed from the heater after use. A preferred smoking article in which tobacco flavor unit 20 can be incorporated is described in above-incorporated U.S. patent application Ser. No. 07/943,504 (PM-1550).

As discussed above, the tobacco flavor material of the present invention can be any material that liberates flavors when heated. If the tobacco flavor material is a continuous sheet, aerosol and flavor generation can be Selectively controlled, in accordance with the present invention, by changing the basis weight, sheet density or casting thickness of the sheet. Additionally, aerosol and flavor generation can also be controlled by increasing the effective surface area of the tobacco flavor material so as to increase the number of surface sites at which aerosol and flavorants can escape. In accordance with the present invention, the effective surface area can be increased by patterning the sheet surface (e.g., by embossing or screen printing the surface). Furthermore, aerosol and flavor generation can also be controlled by increasing the porosity of the tobacco flavor material so as to facilitate the escape of aerosol and flavorants from the tobacco flavor material. This feature of the present invention can be achieved, for example, by perforating the sheet. The above features of the present invention will be discussed in more detail in the Examples below.

The effective surface area of the tobacco flavor material can also be increased by providing a multi-layer tobacco flavor material system. For example, a thin base layer of a tobacco slurry containing a mixture of small-size tobacco grinds, binder and/or other desirable ingredients could be cast onto the carrier or barrier layer as discussed below. On top of this base layer large-size tobacco grinds could be applied (i.e., by broadcast sprinkling or rolling the mat/slurry composite over a bed of tobacco grinds) and then partially embedded into the base slurry layer by a rolling or pressing step. The resulting multi-layer flavor generating system would then have a large effective surface, due to the partially-embedded tobacco grinds, and therefore will have a large number of surface sites at which aerosol and flavorants can escape. This type of flavor generating system results in the generation of aerosol with minimum wasted energy.

If the tobacco flavor material is a foam, gel or slurry (including spray-deposited slurry), aerosol generation can be selectively controlled by changing the solubles content or composition, or by changing the binder composition (e.g., gum composition). Additionally, the method of application can also be used to control aerosol and flavor generation by varying the incorporation of a controlled amount of aerosol- and flavor-producing sites. Facilitating the escape of generated aerosol and flavorants also allows aerosol and flavor generation to be selectively controlled. For example, increasing porosity of a foam, gel or slurry through a reduction in density (i.e., increasing the concentration of air in the foam, gel or slurry), facilitates escape of generated aerosol and flavorants. Because the method of application can influence the density of the tobacco flavor material, the method of application of the tobacco flavor material to the mat of the present invention can be used to control aerosol and flavorant generation. This feature of the present invention allows delivery of aerosol and flavorants to a smoker to be controlled without altering the content or composition of the tobacco flavor material itself. Furthermore, it allows for the efficient generation of aerosol and flavorants with minimum waste of energy. These features of the present invention will be discussed in more detail in the Examples below.

EXAMPLE I

This example illustrates how the heater support structure of the present invention, which employs air gaps, minimizes heat loss in comparison to other heater support structures.

Figure 5A:
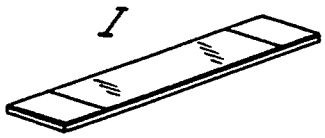
FIGS. 5A–5D illustrate various heater mounting configurations according to the present invention.
Figure 5B:
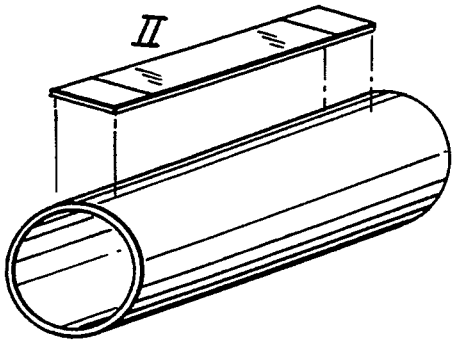
Figure 5C:
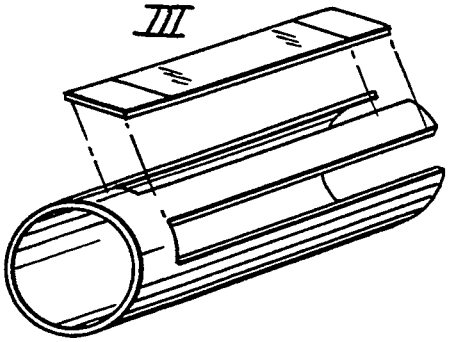
Figure 5D:
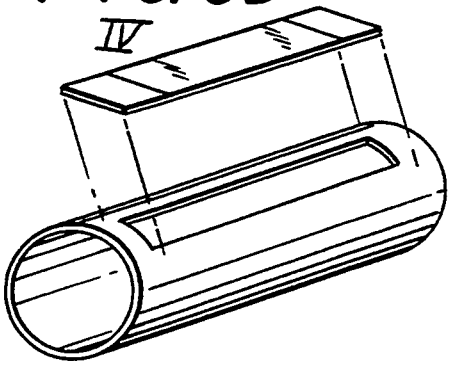

Carbon heaters (10 mm×1.5 mm×0.51 mm, having an active heated surface area of approximately 1.5 mm by 6–7 mm) were heated for one second at two different energy levels. Average maximum surface temperatures were compared for four different heater mounting configurations I–IV. These configurations are shown in FIGS. 5A–5D, respectively. In FIG. 5A, the heater was not mounted on any support structure but was heated in still air in order to compare the effects of heat loss through heater support structures. In FIG. 5B, the heater was mounted on a solid ceramic tube. In FIG. 5C, the heater was mounted on a "finger" of a slotted hollow ceramic tube wherein a slot was adjacent each long side of the heater. This configuration was intended to minimize lateral heat diffusion away from the heater. In FIG. 5D, the heater was mounted on top of a slot wherein each long side of the heater was in thermal contact with the tube, but the underside of the heater was exposed to an air gap instead of ceramic material. This configuration was intended to isolate the effects of lateral heat diffusion.

Average maximum heater surface temperatures and their percentage of the maximum heater temperature of the FIG. 5A configuration (i.e., unsupported heater in still air), as a function of energy inputs, are shown in Table I:

TABLE I

| SUPPORT SYSTEM | RECORDED PEAK TEMPERATURE, °C. ENERGY INPUT @9.7 W-sec | PERCENT OF SYSTEM I | ENERGY INPUT @12.3 W-sec | PERCENT OF SYSTEM I |
|---|---|---|---|---|
| I: | 681 | 100% | 849 | 100% |
| II: | 454 | 67% | 572 | 67% |
| II: | 475 | 70% | 586 | 69% |
| IV: | 619 | 91% | 772 | 91% |

As shown in Table I, heater surface temperatures for unsupported heaters (FIG. 5A) were greatest. Surface temperatures for heaters supported on a solid ceramic tube (FIG. 5B) or on ceramic supports with material removed from each side of the heater (FIG. 5C) were similar, and significantly lower than unsupported heater temperatures. In these cases, the underside of the heaters were in direct physical contact with support material. Lateral heat transfer through the ceramic support, which was minimized in FIG. 5C, was therefore not the major cause of reduced heater surface temperatures. Heaters mounted on the slots of slotted ceramic tubes (FIG. 5D) had maximum surface temperatures close to those of unsupported heaters, verifying this conclusion. Thus, direct heat transfer to the support mass underneath the heaters was a more important factor than lateral heat transfer away from the heater sides.

Example I illustrates the advantage of employing air gaps in the tobacco flavor units discussed above with respect to FIGS. 1–4. Air gaps allow higher heater temperatures to be obtained for a given predetermined electrical power consumption. Alternatively, air gaps allow a given predetermined heater temperature to be obtained for less power consumption.

EXAMPLE II

This example illustrates how a barrier material effects the temperature to which the tobacco flavor material reaches for a given power consumption. Carbon heaters (10 mm×1.5 mm×0.51 mm) were supported on slotted ceramic tubes in a configuration similar to that shown in FIG. 5D. Various types of barriers were brought into intimate thermal contact with the top exposed surface of the carbon heaters (which had an active heated area of approximately 1.5 mm by 6–7 mm). The temperatures of the top surface of the barrier materials (where the tobacco flavor material would normally be placed) were measured for various heater input energies.

Barrier "A" was composed of a 5 mm×20 mm×0.006 mm continuous sheet of aluminum foil (basis weight of approximately 17 g/m$^2$) placed over the heater so that the overhang on each 10 mm side of the heater was approximately 9.25 mm (i.e., the barrier was centered on the heater with the 5 mm side of the barrier parallel to the 10 mm side of the heater).

Barrier "B" was similar to barrier "A" except that it was 5 mm×5 mm so that each side of the heater was left uncovered for 2.5 mm.

Barrier "C" was similar to barrier "A" except that the aluminum foil was 0.013 mm thick (basis weight of approximately 34 g/m$^2$) instead of 0.0065 mm.

Barrier "D" was similar to barrier "A" except that an additional 0.070 paper layer was laminated (using sodium silicate) to the foil to produce a foil/paper laminated barrier having a basis weight of approximately 71 g/m$^2$ and a total thickness of approximately 0.076 mm. The foil-side of the barrier was placed against the heater surface with the 10 mm side of the heater parallel to the 5 mm side of the barrier as in barrier "A".

Barrier "E" was similar to barrier "D" except the paper side of the laminate was placed against the heater surface.

Barrier "F" was similar to barrier "E" except the paper layer was replaced with a continuous carbon fiber paper made by incorporating 9.6 g/m$^2$ of polyacrylonitrile-based carbon fibers into a paper matrix so that the resulting carbon fiber paper had an overall thickness of approximately 0.089 mm and a basis weight of approximately 33.3 g/m$^2$ and was composed of approximately 57% by weight flax fibers, 14% by weight calcium carbonate, and 29% by weight carbon fibers. The carbon fibers were Panex® carbon fibers, purchased from Stackpole Fibers Company (of Lowell, Mass.), then a subsidiary of The Stackpole Corporation and now owned by Zoltek Corporation of St. Louis, Mo.

Barrier "G" was similar to Barrier "E" except the foil was not continuous but periodically interrupted to form 2 mm wide aluminum strips separated 1 mm regions with no aluminum foil.

Figure 6:
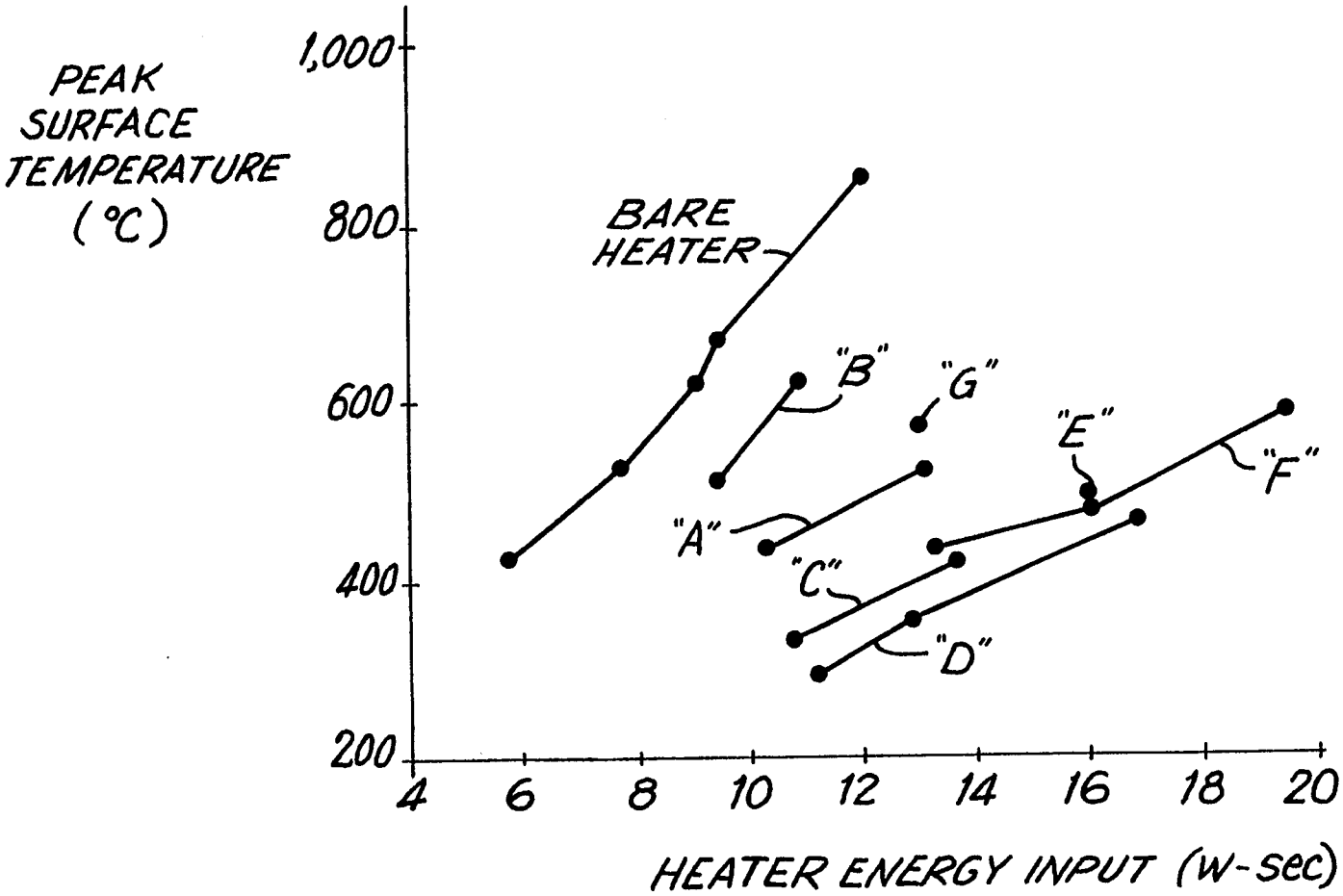
FIG. 6 is a graph showing peak barrier surface temperature versus heater energy input for various barrier types.

FIG. 6 shows peak barrier surface temperature versus heater energy input for barriers "A" through "G" in comparison to the heater temperature when not covered with a barrier (i.e., a bare heater in still air). As can be seen in FIG. 6, placement of any type of barrier on top of a heater reduces the surface temperature of the heater and thus of the barrier itself. The amount of reduction in temperature, however, depends on the type and thickness of the barrier material. For example, FIG. 6 indicates that an energy efficient barrier should minimize the use of continuous thermally-conducting foils and thick insulating papers. Another way to interpret the data in FIG. 6 is that when a barrier is inserted between tobacco flavor material and a heater, more heater energy would have to be employed in order to maintain a given predetermined temperature.

EXAMPLE III

Example II above illustrated how a barrier between a heater and tobacco flavor material can reduce the temperature to which the tobacco flavor material raised. This example illustrates how such temperature reduction translates into reductions in tobacco weight loss after heating a tobacco sheet placed on top of a barrier. Weight loss is attributable primarily to the tobacco flavor substance driven off and intended, in actual use, for delivery to the smoker.

As in Example II, various types of barriers were employed. Barriers "A", "C", "D" and "F" used for this example are the same as those specified in Example II above.

Barrier "H" was similar to barrier "A" except that the 20 mm side was only 2 mm so that the overhang on each side of the heater was approximately 0.25 mm instead of 9.25 mm.

Barrier "I" was similar to barrier "H" except that the aluminum foil was 0.013 mm thick.

Barrier "J" was similar to barrier "F" except the aluminum foil sheet was removed so that the barrier was solely a carbon-fiber reinforced paper.

Barrier "K" was similar to barrier "J" except that the carbon fibers (Panex®) contributed approximately 19.1 g/m$^2$ to the total basis weight and the resulting carbon fiber paper had an overall thickness of approximately 0.17–0.18 mm and a basis weight of approximately 42.6 g/m$^2$ and was composed of approximately 44% by weight flax fibers, 11% by weight calcium carbonate, and 45% by weight carbon fibers.

Barrier "L" was made from low porosity cigarette overwrap paper (composed of approximately 64% by weight flax and 36% calcium carbonate and having an initial basis weight of approximately 63 g/m$^2$) that was treated with phosphate (from $KH_2PO_4$ solution) to provide a barrier having a final basis weight of about 126 g/m$^2$, thickness of approximately 0.15 mm and approximately 50% by weight phosphate salt.

Barrier "M" was made from low porosity cigarette overwrap paper (composed of approximately 67% by weight flax and 33% calcium carbonate and having an initial basis weight of approximately 47.5 g/m$^2$) that was treated with phosphate (from $KH_2PO_4$ solution) to provide a barrier having a final basis weight of 73.7 g/m$^2$, thickness of approximately 0.089 mm and approximately 35.5% by weight phosphate salt.

Barrier "N" was made from phosphate-treated low porosity cigarette overwrap paper (composed of approximately 53.7% by weight flax, 33% calcium carbonate, 13.3% phosphate salt and having an initial basis weight of approximately 47.5 g/m$^2$) that was coated with a solution of konjac flour and more phosphate to provide a barrier having a final basis weight of approximately 175 g/m$^2$, thickness of approximately 0.13 mm. The konjac flour was Nuricol® brand konjac flour available from FMC Corporation, Marine Colloids Division, of Philadelphia, Pa.

The above barriers were placed on the heater surface. On top of the barriers, a control tobacco sheet (basis weight 320 g/m$^2$, thickness 0.18 mm, 1.0 g 400 mesh ground tobacco, 0.07 g glycerin and 3.3 g of 2% konjac-flour solution) was placed. Tobacco flavor material weight loss was measured as a function of heater energy input (17 W-sec and 22 W-sec) and compared to a control sample where no barrier was used. Table II shows the results.

TABLE II

| | 17 W-sec | | 22 W-sec | |
|---|---|---|---|---|
| BARRIER | WEIGHT LOSS, mg | % of CONTROL | WEIGHT LOSS, mg | % OF CONTROL |
| CONTROL-(BARE HEATER) | 1.6 | — | 2.2 | — |
| "A" | 0.8 | 50% | 1.2 | 55% |
| "C" | 0.6 | 38% | 0.7 | 32% |
| "D" | 0.3 | 19% | — | — |
| "F" | 1.0 | 63% | — | — |
| "H" | 1.5 | 94% | 2.1 | 95% |
| "I" | 1.2 | 75% | 1.8 | 82% |
| "J" | 1.0 | 63% | — | — |
| "K" | 0.5 | 31% | 0.8 | 36% |
| "L" | — | — | 0.9 | 41% |
| "M" | — | — | 1.3 | 59% |
| "N" | — | — | 0.6 | 27% |

Table II indicates that the amount of tobacco flavor material weight loss is also influenced by the type of barrier between the heater and the tobacco flavor material. When the data in Table II are compared to the data in FIG. 6, it is concluded that weight loss is correlated with barrier surface temperatures. As expected, higher barrier surface temperatures result in higher tobacco flavor material weight loss.

In order to improve the paper-based barrier systems of Table II, a variety of coatings were also applied to the barriers to determine their effect on weight loss. Such coating included various mixtures of: 1) sodium silicate (Formula D®, available from PQ Corporation of Valley Forge, Pa.), 2) Cepree® (a mixture of glass frits with melting ranges from about 350° C. to about 750° C., available from ICI Americas, Inc. of Wilmington, Del., 3) silica sol-gel (Snowtex-40®, available from Nissan Chemical America Corporation of Tarrytown, N.Y.), 4) a konjac flour-based adhesive solution (to adhere tobacco to barrier), 5) sodium carboxymethylcellulose-based adhesive solution (to adhere tobacco to barrier), 6) alumina sol-gel (to reduce adhesion of barrier to heater), and 7) $Al_2O_3$ powder (to reduce adhesion of barrier to heater).

Weight loss data for the above types of coated paper-based barriers were obtained. Generally, it was observed that cigarette papers coated with sol-gel alone had less efficient barrier properties than the same papers coated with combinations of sodium silicate and Cepree®. However, the additional mass of the more efficient barrier coatings imposed between the tobacco material and heater reduced thermal transfer and, therefore, tobacco material weight loss. With paper-based barriers, there is a compromise between barrier efficiency and thermal transfer, as evidenced by the greater tobacco weight loss with sol-gel coated papers.

EXAMPLE IV

This example illustrates how the basis weight of the tobacco flavor material and the binder type employed in the tobacco flavor material influence tobacco weight loss after heating with a predetermined amount of electrical power.

For this example, the tobacco flavor material was cast from a slurry made of 1.0 g of ground tobacco, 0.1 g of glycerin, 3.4 g of 2% aqueous konjac or pectin binder solution and 2 g of additional water. Two sizes of ground tobacco were employed with the cast slurry: (1) "small," corresponding to grinds which were able to pass through a mesh size of 200 (hereinafter referred to as "<200 mesh" or "small"), or (2) "large," corresponding to grinds that were not able to pass through a mesh size of 200 (hereinafter referred to as ">200 mesh" or "large"). Slurries were prepared with either "large" or "small"-size tobacco grinds as indicated below.

Tobacco flavor material/carrier composites were prepared for testing purposes by hand casting the tobacco slurries directly on top of a carbon fibrous mat. The mat was a Type 8000015 Carbon Fiber Mat (a nonwoven mat consisting of polyacrylonitrile-based fibers bonded into sheet form utilizing a heat-cured latex binder), obtained from International Paper Company of Tuxedo, N.Y. These mats had an overall basis weight of approximately $9\times10^{-3}$ mg/mm$^2$ (approximately 85–95% being the carbon fibers) and a thickness of approximately 0.06 mm. The nominal casting wet thickness of the slurry placed on top of the mat was varied from about 0.13 mm to about 0.3 mm.

In addition to casting a single layer of tobacco slurry on the mat, several double-layer casting samples were also prepared in order to quantitatively measure the influence of tobacco particle size on aerosol and flavor generation. For these particular samples, either a 0.13 mm or a 0.2 mm wet casting of "small" tobacco particle slurry was first cast on the mat. After the first layer air-dried, a second layer of "large" tobacco particle slurry was cast on top of the first layer. This second layer was cast at 0.13 mm for slurries with pectin binder and 0.2 mm or 0.3 mm for slurries with konjac flour binder, since the latter slurries had higher viscosities than comparable slurries with pectin binder. Composites were then air-dried.

Composite samples were cut into 12.5 mm wide strips with lengths long enough to wrap around a complete circumference of a heater spool fixture. The heater fixture included three heaters each having heater surface dimensions of 12.5 mm by 1.5 mm. The strips were secured around the heater spool fixture, with the carbon mat side against the heaters in a configuration similar to that shown in FIGS. 3 and 4 (i.e., carbon mat used as both a carrier and barrier). A power supply was used to sequentially activate the three heaters in one-second pulses. Each composite piece was therefore heated over an area of 3×(12.5 mm by 1.5 mm). Total sample weight before and after heating, and therefore weight loss per three heaters, was recorded.

Sample descriptions, average composite basis weights, and total weight losses at two heater energy inputs (16.3 W-sec and 18.0 W-sec) are listed in Table III. Average composite basis weights were determined for composite pieces before individual test pieces were cut into strips and attached to the heater fixture. In addition, a second basis weight was determined after each sample piece was heated, in order to determine weight loss after heating.

TABLE III

| SAMPLE | AVERAGE BASIS WEIGHT (mg/mm$^2$) | TOTAL WEIGHT LOSS (mg) 16.3 W-sec | 18.0 W-sec |
|---|---|---|---|
| I. KONJAC BINDER (all with 2 g added water, except where noted): | | | |
| <200 mesh/5 mil | 0.044 | 2.7,2.9,2.8 | — |
| <200 mesh/8 mil | 0.073 | 4.0,4.3,3.8 | 4.7,4.8 |
| <200 mesh/12 mil | 0.076 | 4.7,4.2,4.5 | 4.7,4.7 |
| <200 mesh/8 mil no added water | 0.113 | 5.6,4.6,4.8 | — |
| <200 mesh/8 mil + 1 g added water | 0.136 | 5.5,5.4 | 6.5,6.2,7.3,7.5 |
| >200 mesh/5 mil | 0.087 | 5.2,5.5,5.4 | 5.3,6.4,6.1 |
| >200 mesh/8 mil | 0.091 | 5.1,5.3,5.6,5.5; | 5.8,5.8,5.4 |
| >200 mesh/12 mil | 0.122 | 6.0,6.3,6.5 | 7.1,5.7,6.2,6.6 |
| >200 mesh/8 mil no added water | 0.217 | 4.9,4.5 | 5.2,6.9,6.5,5.7 |
| Double cast: <200 mesh/5 mil + >200 mesh/12 mil | 0.180 | 5.9,6.3,6.3 | 7.6,7.2,6.9 |
| Double cast: <200 mesh/8 mil + <200 mesh/8 mil | 0.221 | 6.6,5.6 | — |
| II. PECTIN BINDER (all with 2 g added water): | | | |
| <200 mesh/5 mil | 0.061 | 4.2,4.1,3.8 | — |
| <200 mesh/12 mil | 0.091 | 5.7,5.1,5.1 | 5.9,5.9 |
| >200 mesh/5 mil | 0.106 | 6.4,5.8,6.0 | 6.6,6.3,5.9 |
| >200 mesh/12 mil | 0.150 | 6.3,6.4,5.8 | 7.8,7.5,7.5 |
| Double cast: <200 mesh/5 mil + >200 mesh/5 mil | 0.117 | 5.6,5.3,6.3,5.9; | 6.2,6.2,5.9 |

Figure 7:
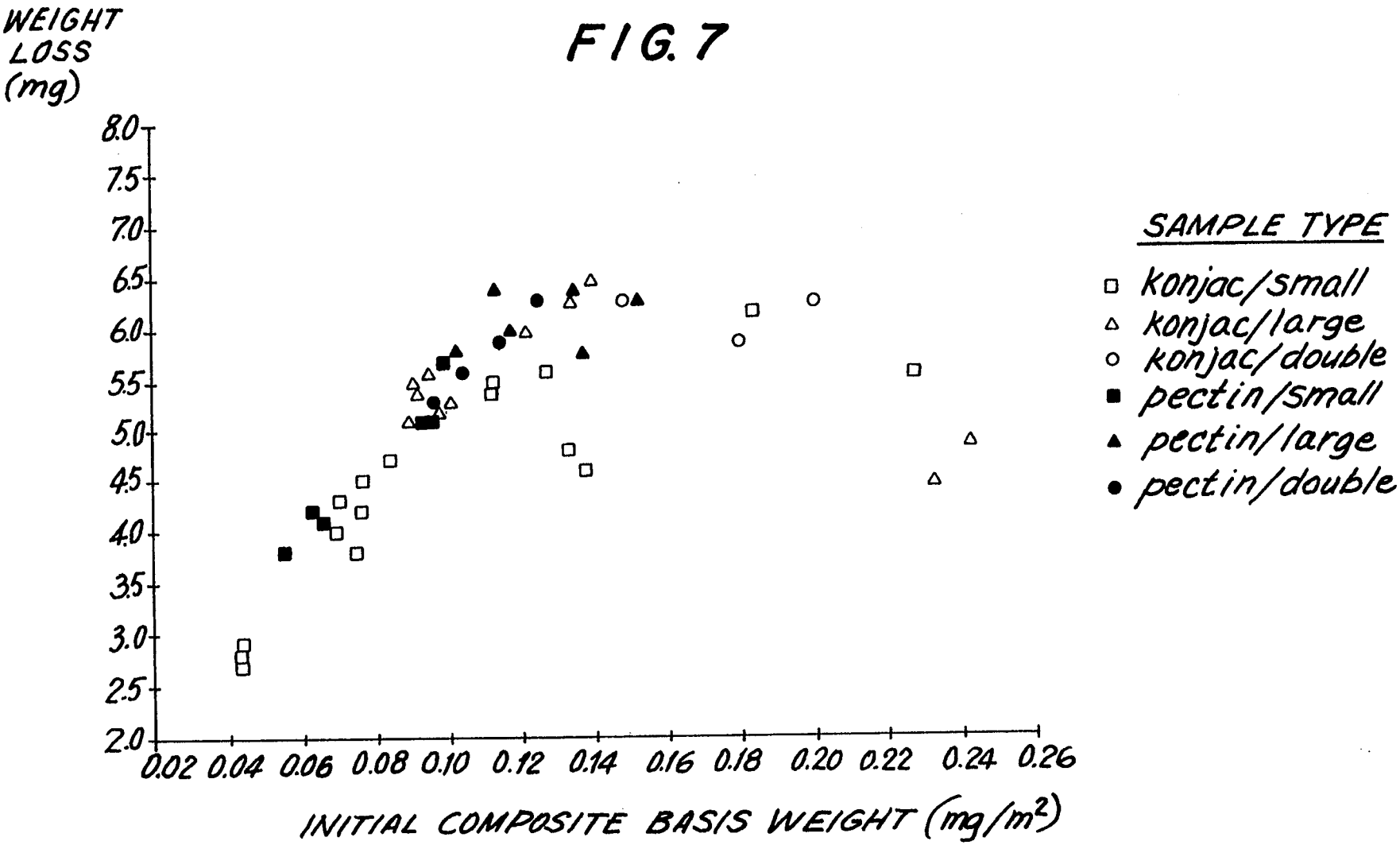
FIGS. 7 and 8 are graphs showing weight loss versus initial composite basis weight for test runs at heater input energy inputs of 16.3 W-sec and 18.0 W-sec, respectively.
Figure 8:
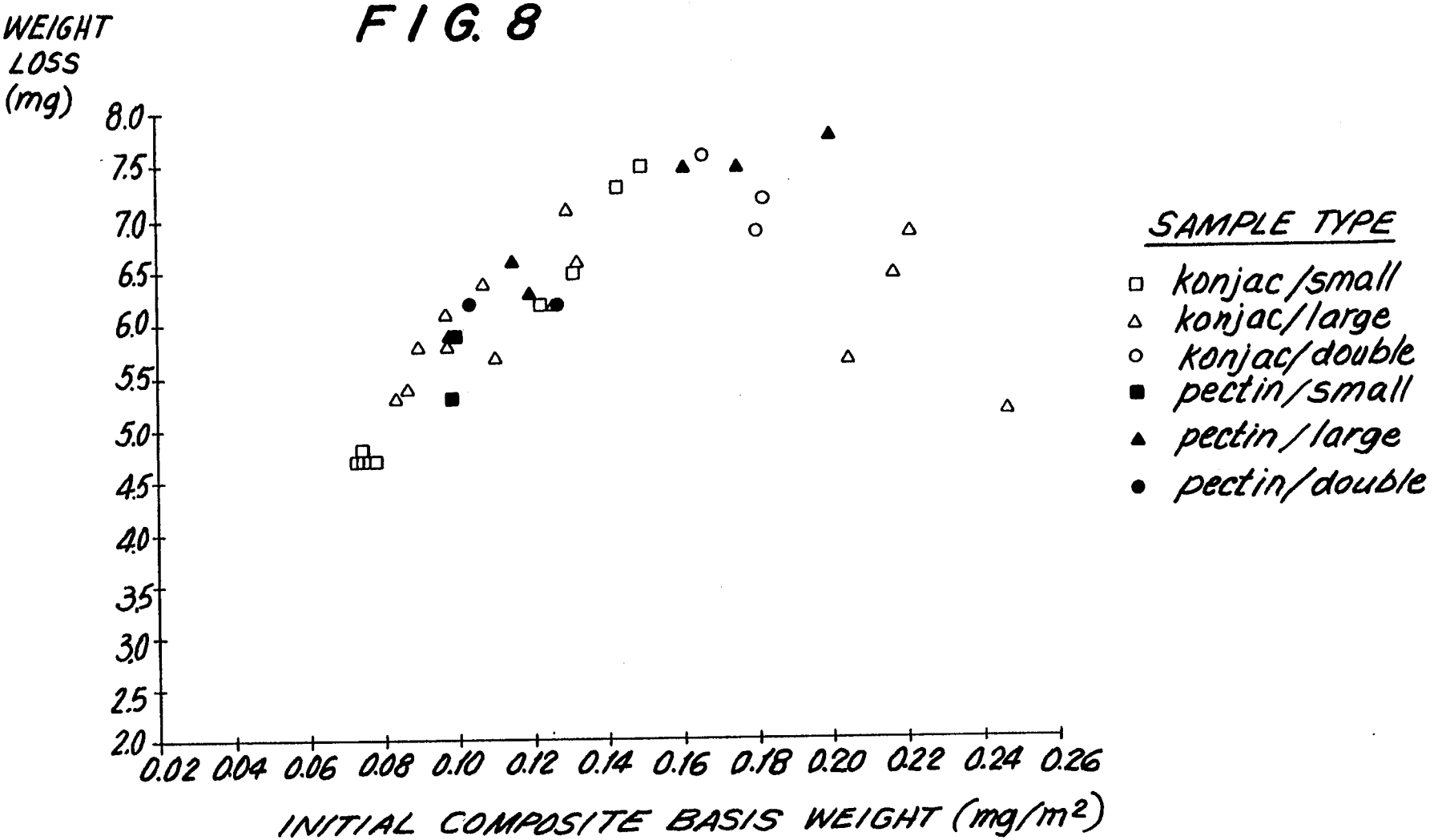

Generally, Table III illustrates that absolute weight losses were lower for low initial basis weight samples regardless of binder type. Weight losses were similar for all samples in an intermediate basis weight range. For high initial basis weight samples, weight loss decreased somewhat. These trends of weight loss versus initial composite basis weight are plotted in FIGS. 7 and 8 for heater energy inputs of 16.3 W-sec and 18.0 W-sec, respectively. As can be seen in FIGS. 7 and 8, the data generally follow a curve where weight loss initially increases at low initial basis weights, then reaches a maximum at intermediate initial basis weights, and then decreases as basis weight continues to increase. Comparing FIG. 7 to FIG. 8, the range for optimum weight loss shifted to higher basis weights at the higher heater energy (18.0 W-sec).

A possible explanation for the trends seen in FIGS. 7 and 8 is as follows. At very low initial tobacco basis weight, weight loss is limited by the available tobacco. Weight loss therefore increases as available tobacco increases (i.e., basis weight increases). For very high basis weights, however, excess tobacco may act as its own heat sink and therefore effectively decrease the heater temperature adjacent the tobacco, similarly to the effect seen in Table I and FIG. 5 discussed above.

Another way to compare the data shown in FIGS. 7 and 8 is to plot Percent Tobacco Weight Loss versus Calculated Heated Weight assuming the area of heated tobacco is equal to the actual heater surface area. Thus, Calculated Heated Weight (CHW) is derived using the equation:

$$CHW = SBW\ (mg/mm^2) \times A_{SUR}\ (mm^2),$$

where SBW is the sample basis weight and $A_{SUR}$ is the total heater surface area. Percent Tobacco Weight Loss (%TWL) is calculated using the equation:

$$\%TWL = [ATWL/CHW] \times 100,$$

where ATWL is the absolute tobacco weight loss. These derived results are plotted in FIGS. 9 and 10 for heater energy inputs of 16.3 W-sec and 18.0 W-sec, respectively.

Figure 9:
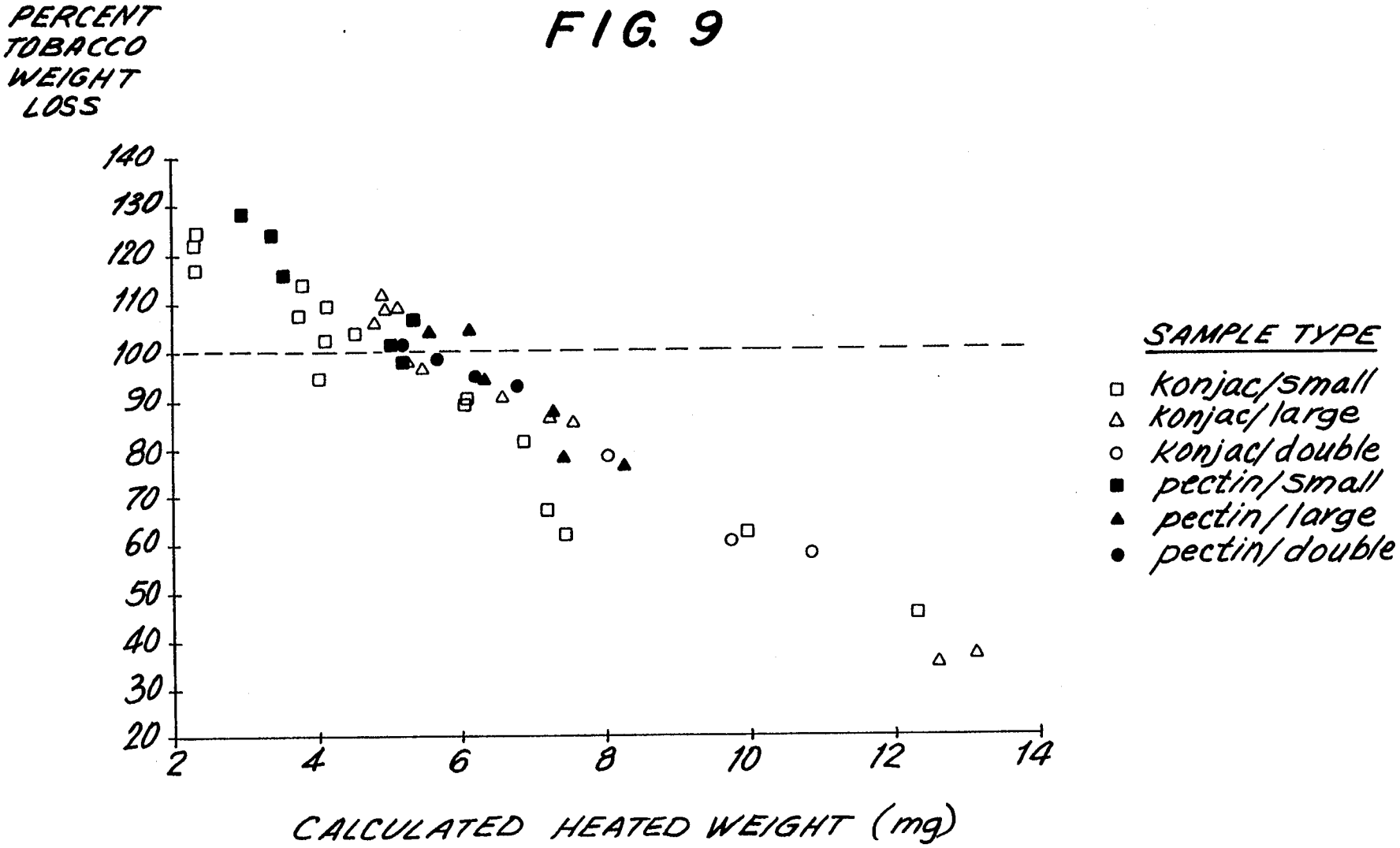
FIGS. 9 and 10 are graphs showing percent tobacco weight loss versus calculated heated weight for the test runs shown in FIGS. 7 and 8, respectively.
Figure 10:
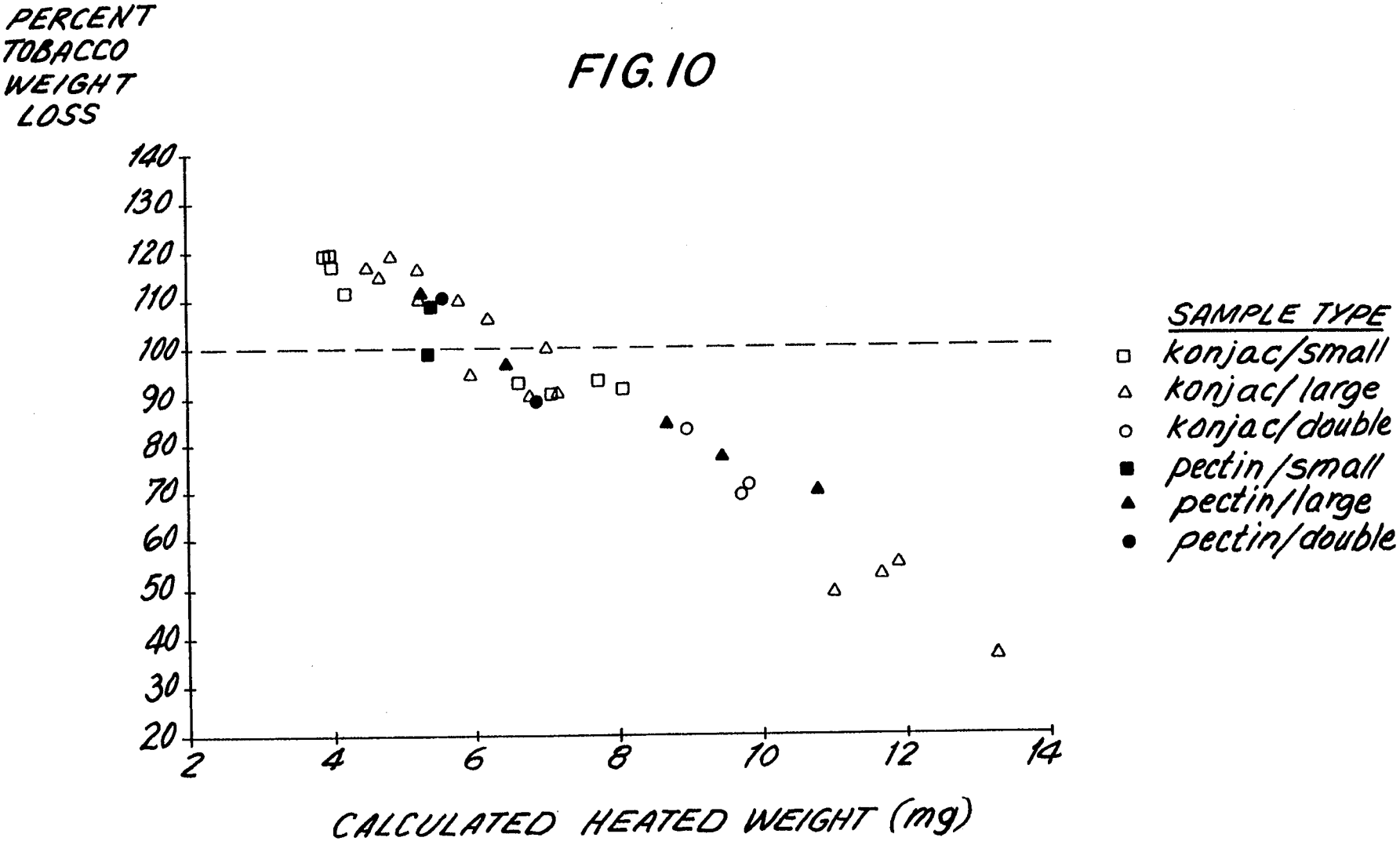

As can be seen in FIGS. 9 and 10, Calculated Percent Weight Losses were greater than 100 percent in low heated weight regions (i.e., low initial basis weight samples). Since the amount of tobacco available at each heater site was low, more tobacco area than just that of the heater area was exposed to elevated temperatures. This was evident from the width of the charred tobacco area (which was greater than the actual heater area) for low basis weight samples.

Calculated Percent Weight Losses gradually decreased with increased heated weight (i.e., basis weight). At high basis weights, excess tobacco is not heated and is therefore wasted because it acts as a heat sink, as discussed above. This trend seems to be independent of tobacco grind particle size and binder type. FIGS. 9 and 10 indicate that in order to optimize the tobacco flavor unit in a smoking article so that tobacco flavor material is not wasted (i.e., percent tobacco weight loss is approximately 100%), the quantity of tobacco flavor material on the carrier must be optimized.

In addition to the samples discussed above, carbon mats coated with silica sol-gel (Snowtex-40 ®, available from Nissan Chemical America Corporation of Tarrytown, N.Y.) were also used to determine weight loss efficiency. Generally, for samples with similar tobacco basis weights, a sol-gel coating on the carbon mat decreased total weight loss. This effect may be due to decreased tobacco penetration into the coated mat. However, it could also be due to the additional sol-gel mass which may reduce heat transfer efficiency to the tobacco system.

EXAMPLE V

Example IV illustrated how the basis weight of the tobacco flavor material influences tobacco flavor material weight loss during heating with a predetermined amount of electrical power. This example illustrates how patterning the surface of a continuous sheet of tobacco flavor material can control the generation of aerosol and other flavorants.

Various compositions of slurries of the types discussed above in Example IV were cast onto carbon fibrous mats (Type 8000015 Carbon Fiber Mat from International Paper). The top surfaces of these slurries were patterned using various techniques discussed below. Heaters were positioned adjacent the carbon mat-side of the composites (similar to that shown in FIGS. 2 and 3). The following trends were observed.

When the wet surface of a slurry was imprinted with a screen pattern (e.g., 17–20 opening per inch with 0.14–0.17 mm screen wire diameters), it was visually observed that aerosol generation improved in the dried cast sheet (i.e., more aerosol was expelled from the top surface of the tobacco flavor material in comparison to when the surface was not patterned).

When the wet surface of a slurry was patterned by embossing with a "roll coater," with 1 mm or 1.3 mm wire diameter rollers (e.g., Leneta Wire-Cators available from BYK Gardner of Silver Spring, Md.), it was visually observed that aerosol generation improved in the dried cast sheet with such embossing of the surface.

When a dried cast sheet was perforated with pins (spacing approximately 1 mm part), it was visually observed that aerosol generation improved with such perforations.

EXAMPLE VI

Example V illustrated how patterning or perforating the surface of the tobacco flavor material can be used to selectively control the generation of aerosol and flavorants. This example illustrates a further technique for increasing the effective surface area of the tobacco flavor material system.

Various tobacco/carbon fibrous mat composites were prepared by applying a top coat of ground tobacco on a wet base coat of tobacco slurry containing 9% by weight konjac flour-type binder, small <200 mesh tobacco grinds, glycerin and water. The base coat of tobacco slurry was initially cast onto a Type 8000015 Carbon Fiber Mat (International Paper) that had an optional thin layer of low viscosity tobacco slurry applied to it, which substantially penetrated the porous fiber mat, and thus facilitated the adhesion of the base coat to the mat and further provided for intimate thermal contact. Tobacco grinds were then applied to the wet base coat by broadcast sprinkling (using sieve screens) or by rolling the mat/wet slurry composite over a bed of grinds. After application of the tobacco grinds, a rolling step was performed to partially embed the ground tobacco into the wet slurry. An optional overspray step (using, for example, a 5% Dextran solution, which is a polysaccharide $[(C_6H_{10}O_5)_n]$, available from Pharmachem Corporation of Bethlehem, Pa.) was further used to assist in adhering the ground tobacco to the wet slurry. The overspray was applied thinly enough (with an air-atomizer) so as to not significantly change the basis weight of the composite.

Table IV shows average basis weight and weight loss (at heater input energy of 18.2 W-sec) for various base coat thicknesses and top coat tobacco grind sizes.

TABLE IV

| BASE COAT WET THICKNESS | TOP COAT GRIND SIZE | AVG. BASIS WEIGHT ($mg/mm^2$) | WEIGHT LOSS (mg) |
|---|---|---|---|
| 0.1 mm | 60–100 mesh | 0.092 | 5.6 |
| 0.1 mm | >200 mesh | 0.180 | 8.1 |
| 1 mm | >200 mesh | 0.206 | 8.1 |
| 0.5 mm | >200 | 0.237 | 7.6 |
| 0.2 mm | >100 mesh | 0.291 | 7.3 |

In addition to the data in Table IV, it was also visually observed that aerosol evolution from the top surface of the tobacco flavor material was very good for the various samples and that thicker base coats, with small <200 mesh grinds, had poorer aerosol evolution than thinner base coats.

Although the fibrous mats discussed above were made from carbon fibers, it will apparent that other thermally stable fibers could be used as well in the tobacco flavor unit of the present invention. For example, inorganic fibers, such as metallic fibers, could be used to enhance a paper or paper-like matrix so that a mat is formed that is capable of functioning as carrier or barrier in a similar fashion to the carbon fibrous mat discussed above.

Thus it is seen that a tobacco flavor unit for use in a smoking article is provided. The tobacco flavor units include tobacco flavor material and a fibrous mat that provides for the efficient generation of tobacco flavor substance. A smoking article incorporating the tobacco flavor unit of the present invention is also provided.

One skilled in the art will appreciate that the present invention can be practiced by other than the described embodiments, which are presented for purposes of illustration and not of limitation, and the present invention is limited only by the claims which follow.

What is claimed is:

1. A tobacco product adapted to cooperate with a discrete source of heat, said tobacco product comprising a fibrous carbon mat and a tobacco flavor material disposed along a first surface of said fibrous carbon mat, an opposite surface of said fibrous carbon mat being substantially free of tobacco flavor material, and said fibrous carbon mat having a basis weight in a range between about 6 $g/m^2$ and 12 $g/m^2$ and being adapted to receive heat at at least one location along said opposite surface and to transfer a substantial portion of said heat to portions of said tobacco flavor material proximate to said location.

2. A tobacco flavor unit for use in a smoking article for delivering to a smoker a tobacco flavor substance, the article having an electrical heater, the tobacco flavor unit comprising:

a carbon fibrous mat comprising carbon fibers at a basis weight of less than or equal to 12 $g/m^2$, said carbon fibers incorporated into a host matrix, said mat having a first surface and a second surface, the mat adapted to be disposed in a region adjacent the electrical heating means; and tobacco flavor medium disposed on the first surface of said mat;

wherein when the electrical heater is activated, a respective fraction of said tobacco flavor medium in thermal transfer relationship with said heater is heated, generating a predetermined quantity of tobacco flavor substance for delivery to the smoker.

3. The tobacco flavor unit of claim 1 wherein the carbon fibrous mat comprises a mat of carbon fibers made from a precursor selected from the group consisting of rayon, pitch and polyacrylonitrile.

4. The tobacco flavor unit of claim 2 wherein the carbon fibers comprise over 90% by weight carbon.

5. The tobacco flavor unit of claim 3 wherein:

the carbon fibrous mat is nonwoven; and the carbon fibrous mat further includes a binder for bonding together the fibers.

6. The tobacco flavor unit of claim 5 wherein:

the binder is selected from the group consisting of polyvinyl alcohol, sugars, starches, modified starches, alginates, cellulose-based adhesives, artificial gums and natural gum; and the binder is suitable for use in a smoking article.

7. The tobacco flavor unit of claim 5 wherein the binder is pectin.

8. The tobacco flavor unit of claim 5 wherein the binder is konjac flour.

9. The tobacco flavor unit of claim 3 wherein the carbon fibers are woven together to form a woven mat.

10. The tobacco flavor unit of claim 1 wherein:

the tobacco flavor medium comprises a sheet of tobacco flavor material having a first surface and second surface, the first sheet surface being in intimate thermal contact with the first surface of the mat; and the second surface of the mat is adapted to be in intimate physical contact with the electrical heating means.

11. The tobacco flavor unit of claim 10 wherein the second sheet surface is patterned so as to increase its effective surface area.

12. The tobacco flavor unit of claim 11 wherein the second sheet surface is embossed.

13. The tobacco flavor unit of claim 11 wherein the second sheet surface is screen printed.

14. The tobacco flavor unit of claim 10 wherein the tobacco flavor material is perforated to increase its porosity.

15. The tobacco flavor unit of claim 1 wherein:

the tobacco flavor medium comprises a sheet of tobacco flavor material having a first surface and second surface, the first sheet surface disposed on the first surface of the mat and the second sheet surface adapted to be in intimate physical contact with the electrical heating means.

16. A tobacco flavor unit for use in a smoking article for delivering to a smoker a tobacco flavor substance, the article having electrical heating means disposed in a cavity, the tobacco flavor unit comprising:

a carbon fibrous mat having a first surface and a second surface, the mat adapted to be disposed in a region adjacent the electrical heating means; and tobacco flavor medium disposed on the first surface of said mat;

wherein when the electrical heating means is activated, a respective fraction of said tobacco flavor medium in thermal transfer relationship with said heating means is heated, generating a predetermined quantity of tobacco flavor substance for delivery to the smoker;

wherein the carbon fibrous mat comprises a mat of carbon fibers made from a precursor selected from the group consisting of rayon, pitch and polyacrylonitrile;

the carbon fibers comprise over 90% by weight carbon;

the carbon fibrous mat is nonwoven;

the carbon fibrous mat further includes a binder for bonding together the fibers;

the binder is selected from the group consisting of polyvinyl alcohol, sugars, starches, modified starches, alginates, cellulose-based adhesives, artificial gums and natural gum;

the binder is suitable for use in a smoking article; and wherein the carbon fibers in the mat have a basis weight in the range from about 6 $g/m^2$ to about 12 $g/m^2$.

17. The tobacco flavor unit of claim 6 wherein the mat has a thickness in the range from about 0.05 mm to about 0.11 mm.

18. The tobacco flavor unit of claim 7 wherein the carbon fibers have diameters substantially in the range from about 7 $\mu m$ to about 30 $\mu m$.

19. A tobacco flavor unit for use in a smoking article for delivering to a smoker a tobacco flavor substance, the article having electrical heating means disposed in a cavity, the tobacco flavor unit comprising:

a carbon fibrous mat having a first surface and a second surface, the mat adapted to be disposed in a region adjacent the electrical heating means; and tobacco flavor medium disposed on the first surface of said mat;

wherein when the electrical heating means is activated, a respective fraction of said tobacco flavor medium in thermal transfer relationship with said heating means is heated, generating a predetermined quantity of tobacco flavor substance for delivery to the smoker;

wherein the carbon fibers are incorporated into a host matrix.

20. The tobacco flavor unit of claim 19 wherein the carbon fibers comprise about 20% to about 90% by weight of the total basis weight of the carbon fibrous mat.

21. The tobacco flavor unit of claim 20 wherein the host matrix is a cellulose-based matrix.

22. The tobacco flavor unit of claim 21 wherein the cellulose-based matrix is a tobacco-based matrix.

23. The tobacco flavor unit of claim 19 wherein the carbon fibrous mat further comprises a binder.

24. The tobacco flavor unit of claim 19 wherein the tobacco flavor medium comprises a slurry deposited on the mat.

25. The tobacco flavor unit of claim 24 wherein the tobacco flavor medium further comprises a second slurry deposited on top of the first slurry.

26. The tobacco flavor unit of claim 24 wherein the tobacco flavor medium further comprises tobacco grinds on the surface of the slurry, said tobacco grinds increasing the effective surface area of the tobacco flavor material.

27. The tobacco flavor unit of claim 24 wherein at least some of the grinds are embedded into the slurry.

28. The tobacco flavor unit of claim 25 wherein the tobacco flavor medium further comprises an added binder adhering the tobacco grinds to the slurry.

29. A smoking article for delivering to a smoker a tobacco flavor substance, said article comprising:

a plurality of electrical heaters;

a source of electrical energy for powering said plurality of heaters;

control means for applying said electrical energy to said heaters to selectively heat at least one of said plurality of heaters; and a tobacco flavor unit comprising:

a carbon fibrous mat having a first surface and a second surface, the mat adapted to be disposed in a region adjacent the plurality of electrical heaters; and tobacco flavor medium disposed on the first surface of said mat;

wherein when any one of said plurality of electrical heaters is activated, a respective fraction of said tobacco flavor medium in thermal transfer relationship with said one of said heaters is heated, generating a predetermined quantity of tobacco flavor substance for delivery to the smoker;

the carbon fibrous mat comprises a mat of carbon fibers made from a precursor selected from the group consisting of rayon, pitch and polyacrylonitrile;

wherein the carbon fibers comprise over 90% by weight carbon;

wherein the carbon fibrous mat is nonwoven; and the carbon fibrous mat further includes a binder for bonding together the fibers;

wherein the binder is selected from the group consisting of polyvinyl alcohol, sugars, starches, modified starches, alginates, cellulose-based adhesives. artificial gums and natural gums; and the binder is suitable for use in a smoking article; and wherein the carbon fibers in the mat have a basis weight in the range from about 6 $g/m^2$ to about 12 $g/m^2$.

30. The smoking article of claim 29 wherein the mat has a thickness in the range from about 0.05 mm to about 0.11 mm.

31. The smoking article of claim 29 wherein the carbon fibers have diameters substantially in the range from about 7 $\mu$m to about 30 $\mu$m.

32. The smoking article of claim 29 wherein the binder is pectin.

33. The smoking article of claim 29 wherein the binder is konjac flour.

34. The smoking article of claim 29 wherein the carbon fibers are incorporated into a host matrix.

35. The smoking article of claim 34 wherein the carbon fibers comprise about 20% to about 90% by weight of the total basis weight of the carbon fibrous mat.

36. The smoking article of claim 35 wherein the host matrix is a cellulose-based matrix.

37. The smoking article of claim 36 wherein the cellulose-based matrix is a tobacco-based matrix.

38. The smoking article of claim 34 wherein the carbon fibrous mat further comprises a binder.

39. The smoking article of claim 29 wherein the carbon fibers are woven together to form a woven mat.

40. The smoking article of claim 29 wherein:

the tobacco flavor medium comprises a sheet of tobacco flavor material having a first surface and second surface, the first sheet surface being in intimate thermal contact with the first surface of the mat; and the second surface of the mat is adapted to be in intimate physical contact with the electrical heating means.

41. The smoking article of claim 40 wherein the second sheet surface is patterned so as to increase its effective surface area.

42. The smoking article of claim 41 wherein the second sheet surface is embossed.

43. The smoking article of claim 41 wherein the second sheet surface is screen printed.

44. The smoking article of claim 40 wherein the tobacco flavor material is perforated to increase its porosity.

45. The smoking article of claim 29 wherein the tobacco flavor medium comprises a slurry deposited on the mat.

46. The smoking article of claim 45 wherein the tobacco flavor medium further comprises a second slurry deposited on top of the first slurry.

47. The smoking article of claim 45 wherein the tobacco flavor medium further comprises tobacco grinds on the surface of the slurry, said tobacco grinds increasing the effective surface area of the tobacco flavor material.

48. The smoking article of claim 47 wherein at least some of the grinds are embedded into the slurry.

49. The smoking article of claim 48 wherein the tobacco flavor medium further comprises an added binder adhering the tobacco grinds to the slurry.

50. The smoking article of claim 29 wherein:

the tobacco flavor medium comprises a sheet of tobacco flavor material having a first surface and a second surface, the first sheet surface disposed on the first surface of the mat and the second sheet surface adapted to be in intimate physical contact with the electrical heating means.

51. The smoking article of claim 29 wherein each of the plurality of electrical heaters has a first surface and second surface and wherein the first surface of each heater is adapted to be in intimate physical contact the tobacco flavor unit.

52. The smoking article of claim 51 wherein the second surface of each heater is adapted to be substantially surrounded by a thermal insulation layer so as to reduce heat transfer in a direction away from the tobacco flavor medium.

53. The smoking article of claim 52 wherein the carbon fibrous mat further comprises a binder.

54. The smoking article of claim 52 wherein the carbon fibers are woven together to form a woven mat.

55. The smoking article of claim 52 wherein:

the tobacco flavor medium comprises a sheet of tobacco flavor material having a first surface and second surface, the first sheet surface being in intimate thermal contact with the first surface of the mat; and the second surface of the mat is adapted to be in intimate physical contact with the electrical heating means.

56. The smoking article of claim 55 wherein the second sheet surface is patterned so as to increase its effective surface area.

57. The smoking article of claim 55 wherein the second sheet surface is embossed.

58. The smoking article of claim 55 wherein the second sheet surface is screen printed.

59. The smoking article of claim 55 wherein the tobacco flavor material is perforated to increase its porosity.

60. The smoking article of claim 59 wherein the tobacco flavor medium comprises a slurry deposited on the mat.

61. The smoking article of claim 60 wherein the tobacco flavor medium further comprises tobacco grinds on the surface of the slurry, said tobacco grinds increasing the effective surface area of the tobacco flavor material.

62. The smoking article of claim 61 where at lease some of the grinds are embedded into the deposited slurry.

63. The smoking article of claim 62 wherein the tobacco flavor medium further comprises an added binder adhering the tobacco grinds to the slurry.

64. The smoking article of claim 55 wherein the tobacco flavor medium further comprises a second slurry deposited on top of the first slurry.

65. The smoking article of claim 51 wherein the mat has a thickness in the range from about 0.05 mm to about 0.11 mm.

66. The smoking article of claim 51 wherein the carbon fibers have diameters substantially in the range from about 7 μm to about 30 μm.

67. The smoking article of claim 51 wherein the binder is pectin.

68. The smoking article of claim 51 wherein the binder is konjac flour.

69. The smoking article of claim 68 wherein the carbon fibers are incorporated into a host matrix.

70. The smoking article of claim 69 wherein the carbon fibers comprise about 20% to about 90% by weight of the total basis weight of the carbon fibrous mat.

71. The smoking article of claim 69 wherein the host matrix is a cellulose-based matrix.

72. The smoking article of claim 66 wherein the cellulose-based matrix is a tobacco-based matrix.

73. The smoking article of claim 29 wherein:

the tobacco flavor medium comprises a sheet of tobacco flavor material having a first surface and second surface, the first sheet surface disposed on the first surface of the mat and the second sheet surface adapted to be in intimate physical contact with the electrical heating means.

74. A tobacco flavor unit for use in a smoking article for delivering to a smoker a tobacco flavor substance, the smoking article having electrical heating means disposed in a cavity, the tobacco flavor unit comprising:

a fibrous mat having a first surface and a second surface, the mat adapted to be disposed in a region adjacent the electrical heating means, wherein said mat comprises a mat of inorganic, thermally stable fibers which are incorporated into a host matrix; and tobacco flavor medium disposed on the first surface of said mat;

wherein when the electrical heating means is activated, a respective fraction of said tobacco flavor medium in thermal transfer relationship with said heating means is heated, generating a predetermined quantity of tobacco flavor substance for delivery to the smoker.

75. The tobacco flavor unit of claim 74 wherein the inorganic fibers comprise metallic fibers.

* * * * *